United States Patent [19]

DiTommaso et al.

[11] Patent Number: 4,586,680

[45] Date of Patent: May 6, 1986

[54] SPRING-ERECTED TELESCOPIC WING SUPPORT STRUCTURE

[75] Inventors: Anthony DiTommaso, Upland; Ronald T. Inglis, Laguna Beach; Richard C. Worley, Pomona; Ramon J. Renda, Montclair, all of Calif.

[73] Assignee: General Dynamics Pomona Division, Pomona, Calif.

[21] Appl. No.: 347,396

[22] Filed: Feb. 10, 1982

[51] Int. Cl.[4] ..... F42B 13/32

[52] U.S. Cl. ..... 244/3.27; 244/3.28; 244/3.24

[58] Field of Search ..... 244/3.24, 3.27, 3.28, 244/3.29, 16, DIG. 1

[56] References Cited

U.S. PATENT DOCUMENTS

| | | | |
|---|---|---|---|
| 2,365,577 | 12/1944 | Moore | 244/3.28 |
| 3,826,448 | 7/1974 | Burk, Jr. | 244/91 |
| 4,072,107 | 2/1978 | Saxe et al. | 102/4 |
| 4,351,499 | 9/1982 | Maudal | 244/3.27 |

FOREIGN PATENT DOCUMENTS

| | | | |
|---|---|---|---|
| 788868 | 7/1968 | Canada | 244/1.5 |
| 1199644 | 8/1965 | Fed. Rep. of Germany | 244/3.28 |
| 1203647 | 10/1965 | Fed. Rep. of Germany | 244/3.27 |
| 2059023 | 4/1981 | United Kingdom | 244/3.27 |

*Primary Examiner*—Donald P. Walsh

*Attorney, Agent, or Firm*—Neil F. Martin; Edward B. Johnson

[57] ABSTRACT

A wing support structure for a self-erecting collapsible wing includes a telescoping strut assembly including a leading strut and a trailing strut each pinned at an inner end to fixed pins on a base support structure and pinned to a common pivot pin at the outer end and each strut being telescoping for retraction to a colinear position and spring biased to an outward fully deployed position. Each strut includes inner and outer tubular strut members in which is confined a compression spring with the inner and outer members including an antirotation lock and an anticollapse lock.

20 Claims, 11 Drawing Figures

SPRING-ERECTED TELESCOPIC WING SUPPORT STRUCTURE

BACKGROUND OF THE INVENTION

The present invention relates to rockets and missiles and pertains particularly to collapsible wing structures for such missiles.

Many rockets and missiles utilize some form of wing or stabilizer structure for stabilizing and guiding the missile during flight. Missiles are frequently stored and launched from tubular launchers and are frequently deployed from aircraft or other missiles. Under such circumstances it is frequently necessary to minimize the space for the missile until it is launched. Folding wings of various types and configurations have been utilized in the past to minimize the space required for such missiles.

The premium for space requires that the folding or collapsing wing structures be foldable or collapsible to a minimum space. In addition, the flight characteristics of the missile require optimum reliability and performance of the deployed wing structure. It is therefore desirable that the folding wing structure have highly efficient flight characteristics and, at the same time, be foldable to a minimum space.

SUMMARY AND OBJECTS OF THE INVENTION

It is therefore the primary object of the present invention to provide an improved wing support structure for collapsible wings.

In accordance with the primary aspect of the present invention, a telescopic wing support structure for a collapsible and extensible wing structure includes inner and outer telescoping strut members including a leading strut and a trailing strut, each pivoted at an inner end to a fixed hinge pin and including tubular telescoping inner and outer members with the inner members pinned to a common floating hinge pin and being telescopically compressed to a colinear position with coil springs disposed within the tubular strut members for biasing the members to the fully deployed extended position.

BRIEF DESCRIPTION OF THE DRAWINGS

The above and other objects and advantages of the present invention will become apparent from the following description when read in conjunction with the accompanying drawings wherein.

DETAILED DESCRIPTION OF A PREFERRED EMBODIMENT

Figure 1:
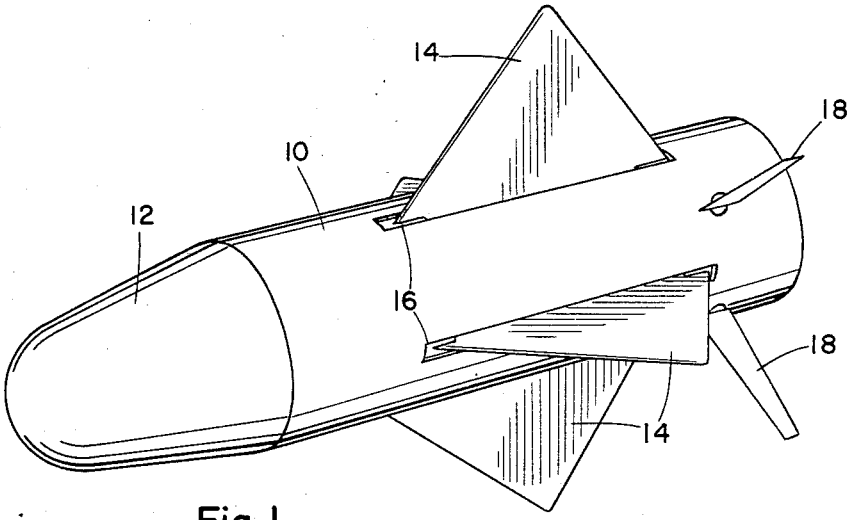
FIG. 1 is a perspective view of a missile incorporating the self-erecting wing structure.
Figure 2:
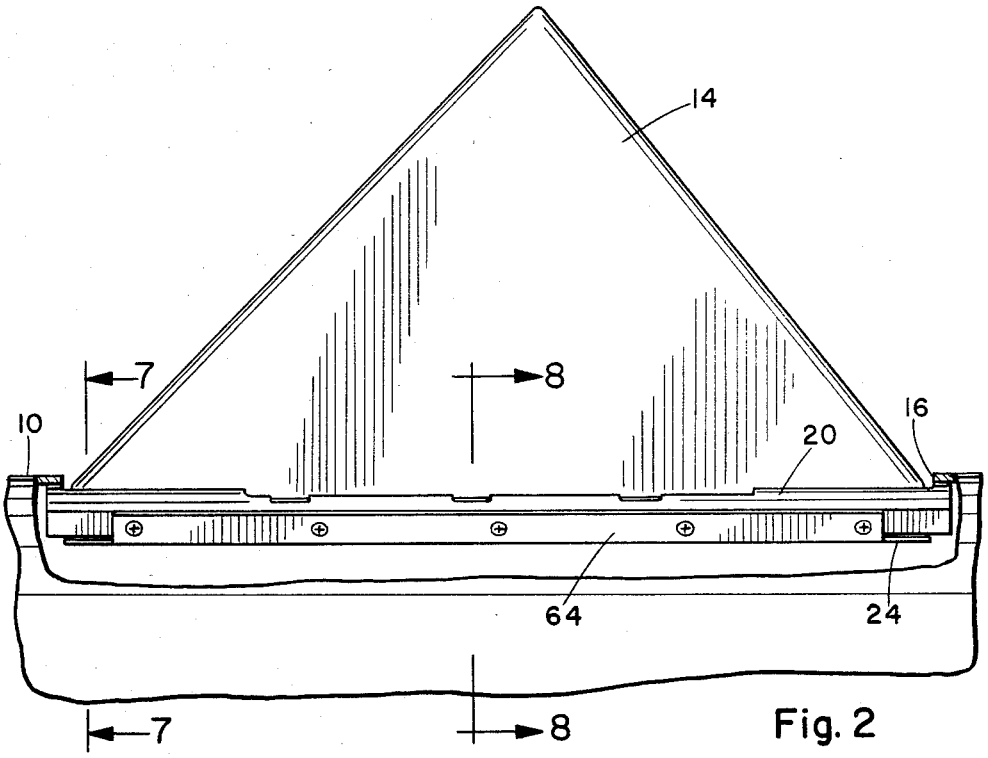
FIG. 2 is an enlarged side elevation view of a single erected wing unit.

Turning to the drawings, there is illustrated in FIG. 1 a missile having a generally cylindrical body 10 with a nose cone 12 and a plurality of radially outwardly extending wings 14 extending outwardly from a plurality of circumferentially arranged longitudinally extending slots 16 in the body 10. A plurality of guiding or steering fins or rudders 18 extend radially outward from the tail end of the missile body.

The missile can have any suitable form of guidance and propulsion systems and any required configuration of warhead. The missile can be launched in any suitable manner such as from ground vehicles or locations, aircraft, or other missiles. The space saving developments of the present invention, however, were primarily developed for utilization in missiles transported by other missiles wherein space and reliability is a premium.

The wings can have any suitable configuration with the illustrated embodiment having a generally triangular configuration. The wing is constructed of a flexible or pliable material such as a lightweight nylon or dacron and is cut and sewn in a way that it precisely conforms to the supporting strut assembly in its extended position.

Figure 7:
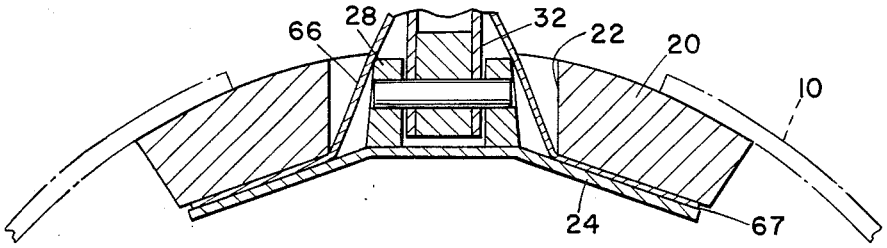
FIG. 7 is an enlarged sectional view taken on line 7—7 of FIG. 2.

The wing assembly is self-contained and is a completely operable modular unit that can be detachably mounted within the rocket body positioned for extension or retraction of the wing through a slot in the rocket body. The wing assembly includes a channel housing 20 having an elongated multiwidth slot 22 extending the length of the housing. The housing 20 has an outer configuration conforming substantially to the shape of the surface of the missile and includes means that will be described, including a disposable cover for covering the retracted wing opening. The housing body 20 includes a base plate 24 as can best be seen in FIGS. 7 through 9. The base plate 24 is detachable from the housing 20 and serves as the primary attachment structure for the wing struts. The base plate 24 also clamps the wing covering fabric between the base plate and housing.

Figure 9:
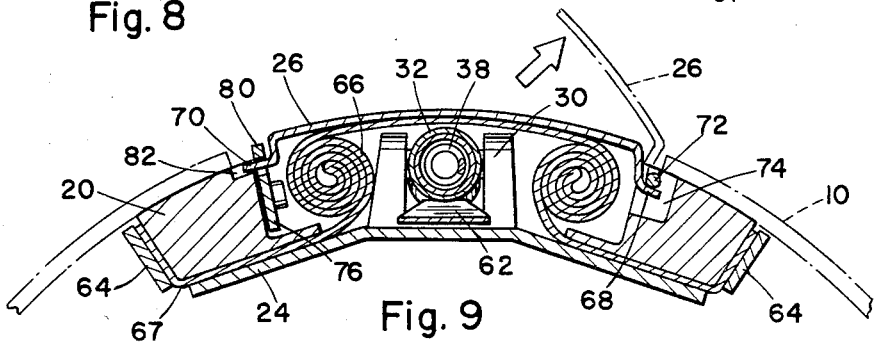
FIG. 9 is an enlarged sectional view taken on line 9—9 of FIG. 6.

The housing is of a depth and width to receive and enclose the collapsed wing strut assembly and the fabric covering thereof and includes a detachable cover 26 as shown in FIG. 9 for covering the retracted wing pocket.

Figure 4:
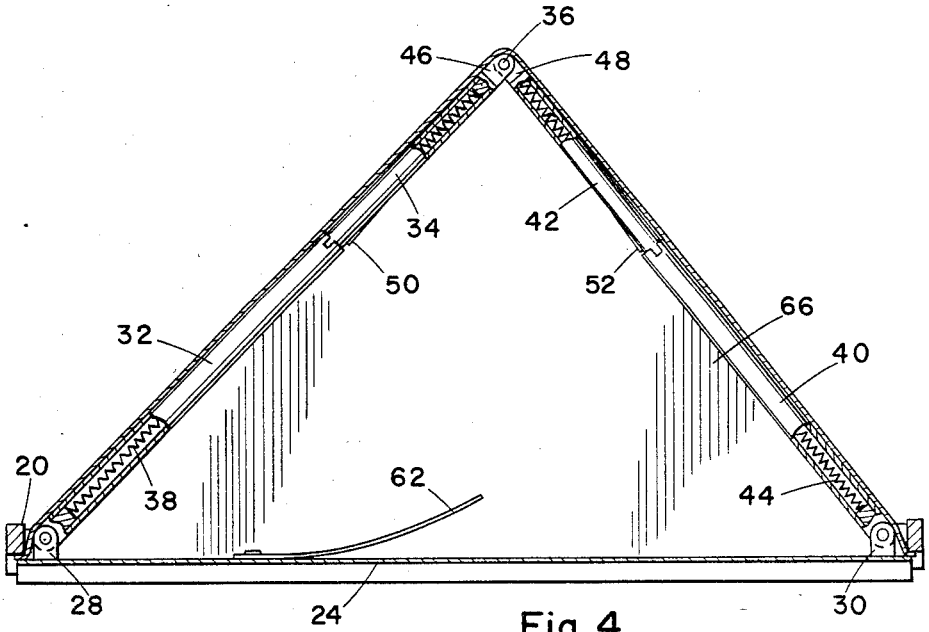
FIG. 4 is a sectional view taken on line 4—4 of FIG. 3.

The support strut assembly for the wing fabric is best seen in FIG. 4 and includes a forward strut assembly pivotally mounted or hinged on a forward hinge bracket 28 mounted to the forward end of the bottom plate 24 and a trailing strut pivotally mounted to a trailing hinge bracket 30 secured to the bottom plate 24. The forward strut includes a lower outer tubular strut member 32 pivotally mounted or hinged to the bracket 28 and telescopingly receiving an inner tubular strut member 34 which is pivotally secured by means of a hinge pin 36 at the outer end to the trailing strut. A compression spring 38 is mounted within the bore of both the lower and upper tubular members 32 and 34 and extends substantially the full length thereof. This spring is preferably under sufficient compression at its outermost position to retain the strut in its extended position under normal circumstances.

The trailing strut is substantially identical to the leading strut including a lower tubular strut member 40 hinged to the hinge bracket 30 and telescopingly receiving a tubular inner or upper tubular strut member 42. A compression spring 44 is confined within the bore of the tubular members and extends substantially the full length thereof and similarly is under compression at its outermost position for retaining the strut in its extended position.

Figure 10:
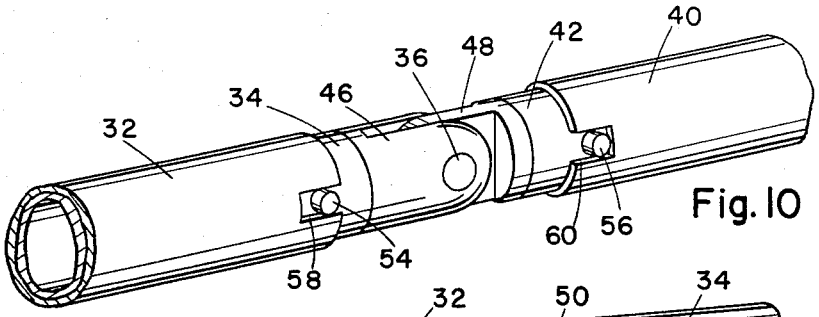
FIG. 10 is a perspective view of the wing strut joint and alignment means.

Turning to FIG. 10, the outer end of inner strut member 34 includes a bifurcated hinge bracket member 46 receiving a hinge member 48 of the inner strut member 42.

Figure 11:
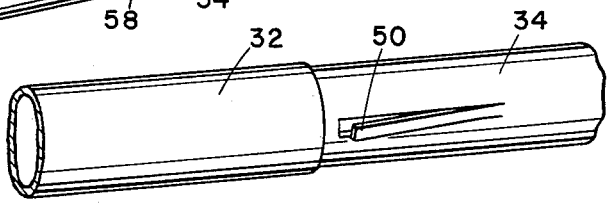
FIG. 11 is a perspective view of one wing strut lock arrangement.

Each strut is provided with an extension or anticollapse lock to prevent the wing loading from compressing the strut. These locks are formed as tabs 50 and 52 on the inner struts 34 and 42, respectively. This strut lock as best shown in detail in FIG. 11, actually consists of a small finger or tab formed by cutting a narrow U-shaped slot in the wall of the upper strut member. The finger so formed is bent or forced outward with its free end pointing toward the open end of the upper strut 34 or 42 such that when biased outward it engages the outer end of the outer strut member 32 or 40. The free end is bent outward and twisted slightly, approximately 10° and specifically located above the outer end of the lower strut when the wing is in its erected position. The strut lock is preferably located on the underside of the strut member away from the fabric covering to prevent or avoid damage thereto, but is positioned to be squeezed or pressed by the finger to the disengaged position below the inside diameter of the lower strut member to permit intentional collapse of the strut.

Figure 6:
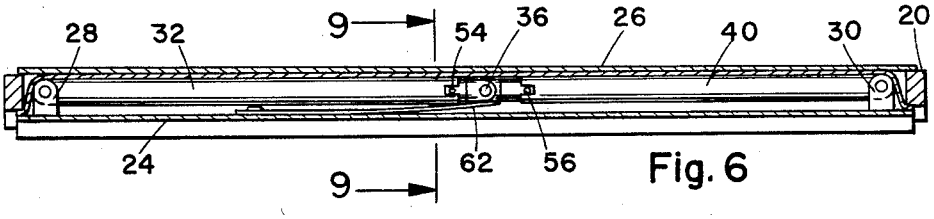
FIG. 6 is sectional view, similar to FIG. 4, but with the wing folded and a retaining cover in place.

At least one of the struts should be provided with an antirotation lock to prevent accidental rotation of the outer strut members when the struts are in a colinear or collapsed position. Turning to FIGS. 6 and 10, antirotation locks are provided and each respectively consists of pins 54 and 56 extending outward from the upper strut member at a position to engage slots 58 and 60 at the outer end of the lower strut members 32 and 40 upon complete collapse of the strut assembly to the colinear position as shown in FIGS. 6 and 10. Although two locks are illustrated, one for each strut, a single lock would appear to serve the purpose in most instances.

Turning now to FIG. 4, a leaf spring 62 is disposed or mounted on the base plate 24 disposed between the fixed hinge pins 28 and 30 and directly beneath the strut assembly for engaging and applying a force to the strut assembly below the hinge pin 36 upon folding of the struts to the collapsed position as shown in FIG. 6. This spring 62 provides an initial outward thrust or force on the struts preventing them from locking in the collapsed position.

Figure 8:
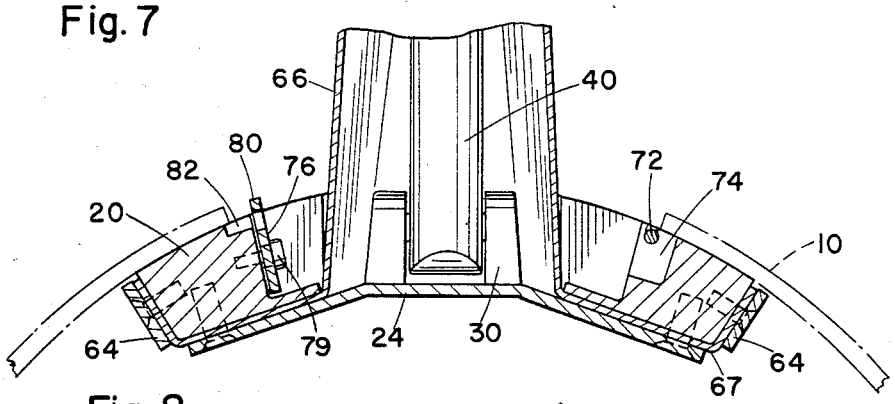
FIG. 8 is an enlarged sectional view taken on line 8—8 of FIG. 2.

The fabric cover 66 of the wing, as previously discussed, is shaped to encompass the strut structure and includes a base portion or skirt portion 67 that is secured to the wing housing 20 by clamping between the base plate 24 and the housing and including peripheral clamp plates 64 as can be seen in FIGS. 8 and 9. These ensure a secure attachment of the wing fabric to the wing structure.

The above described wing can be collapsed into a folded position and rolled within the wing housing as shown in FIG. 9. This is accomplished by compressing the strut locks and applying a force at the tip of the wing in a direction that telescopically compresses or collapses the two struts. The struts become progressively shorter and pivot about the lower hinge pins until they reach the fully folded or collapsed position where they are colinear and lying against the base plate 24 as shown in FIGS. 6 and 9. At this point, the compression springs 38 and 44 within the two struts are fully compressed to very near their solid heights at which position they deliver their maximum force. With the struts in this position, however, the spring force is in a direction colinear or coaxially thereof and does not tend to force the wings open. In order to initiate unfolding of the wings, it is necessary to bias or force the strut from this position. This is accomplished by means of the leaf spring 62 applying a force biasing the struts a small distance outward such that the compression springs within the struts act to quickly snap the wing outward to its fully extended position. The spring 62 is positioned with one end attached to the base plate 24 and shaped and curved outward therefrom as shown in FIG. 4, such that when the struts are in a fully collapsed position as shown in FIG. 6 the spring is loaded to provide an initial force for extension of the struts and wing assembly.

Figure 3:
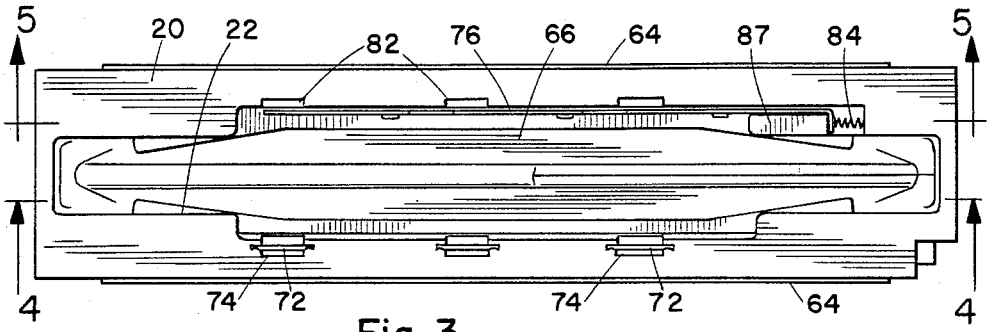
FIG. 3 is a top plan view of the wing unit.
Figure 5:
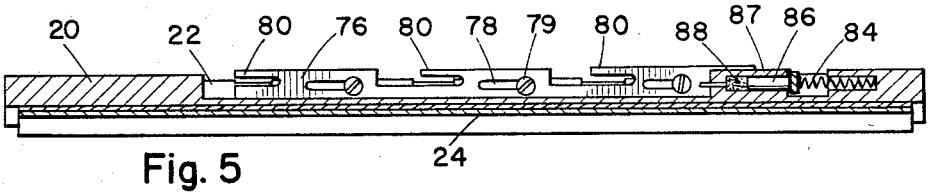
FIG. 5 is a sectional view taken on line 5—5 of FIG. 3.

A releasable wing cover 26 is adapted to extend over and cover the folded wing structure as best seen, for example, in FIGS. 6 and 9. The wing cover 26 comprises an elongated generally rectangular plate covering the housing opening when the wing is folded therein. The wing cover 26 as best seen in FIG. 9 includes a plurality of hinge tabs 68 on one side or extending along one side of the cover and a plurality of latch tabs 70 extending along the other side of the cover. The upper surface of the cover as seen in FIG. 9 is curved to conform generally to the configuration of the missile housing to provide minimum resistance to airflow and to eliminate space occupying protruberances. As best seen in FIG. 3, a plurality of hinge pins 72 are mounted in a plurality of slots or depressions 74 along one side of the wing housing. A slideable latch plate 76 as shown in FIG. 5 is secured by means of a plurality of slots 78 and shoulder screws 79 to the side wall of the housing with a plurality of latch fingers 80 biased to a position overlapping a plurality of tab receiving slots 82 in the sidewall of the housing. The latch plate is biased by means of a compression spring 84 at one end of the plate and housing. A plunger 86 within a cylinder 87 engaging the end of the latch plate is provided with a small explosive charge 88 within a chamber which is ignited to shift the latch plate to the released position for release of the cover. Release of the cover permits the strut assembly to extend, forcing the cover outwards. The cover is then swept away by airflow along the missile body. The wing is then free to snap out to its fully deployed position.

While we have illustrated and described our invention by means of specific embodiments, it is to be understood that numerous changes and modifications may be made therein without departing from the spirit and scope of the invention as defined in the appended claims.

We claim:

1. An extensible strut assembly for a self-erecting wing, said strut assembly comprising:

a leading strut and a trailing strut, each strut comprising a lower telescoping tubular member that is hollow along substantially its entire length pivotally mounted at the lower end on a fixed hinge pin, and an upper telescoping tubular member that is hollow along substantially its entire length telescopically mounted in said lower tubular member and pivotally connected to a common hinge pin, and, a compression spring disposed within and extending substantially the length of both the lower and upper telescoping strut member of each strut.

2. The strut assembly of claim 1 including an alignment pin and slot on at least one of said struts for maintaining alignment of said struts.

3. The strut assembly of claim 2 wherein said compression spring is substantially bottomed when said struts are collapsed to a colinear position.

4. The strut assembly of claim 3 wherein at least one of said leading strut and said trailing strut includes locking means for locking said strut in the extended position.

5. The strut assembly of claim 4 including a base plate, and said fixed hinge pins are fixed to said plate.

6. The strut assembly of claim 5 including spring means mounted on said base plate for engaging said strut assembly in the retracted position for biasing same toward the extended position.

7. The strut assembly of claim 5 wherein said struts are mounted within a double walled flexible wing body.

8. The strut assembly of claim 7 including an elongated housing having walls defining an elongated chamber, said base plate defining the bottom of said housing, and said struts are mounted on said plate and positioned for collapsing to a position totally within said chamber, and detachable cover means covering said chamber for retaining said struts in a collapsed position within said housing.

9. The strut assembly of claim 8 including releasable latching means for retaining said cover on said housing.

10. The strut assembly of claim 9 including spring means mounted on said base plate for engaging and biasing said struts from the colinear position when said cover is released.

11. An extensible strut assembly for a self-erecting wing, said strut assembly comprising:

a leading strut and a trailing strut, each strut comprising a lower telescoping tubular member pivotally mounted at the lower end on a fixed hinge pin, and an upper telescoping tubular member telescopically mounted in said lower tubular member and pivotally connected to a common hinge pin, said struts being collapsible to a colinear position and extendable outwardly to a fully deployed position;

a compression spring disposed within the lower and upper telescoping strut member of each strut wherein said compression spring is substantially bottomed when said struts are colapsed to the colinear position.

an anti-rotation alignment pin and slot on at least one of said struts for maintaining alignment of the upper and lower tubular members of said struts about the axis thereof when in the colinear position; and, at least one of said leading strut and said trailing strut includes locking means for locking said strut in the extended position.

12. The strut assembly of claim 11 including a base plate, and said fixed hinge pins are fixed to said plate.

13. The strut assembly of claim 12 including spring means mounted on said base plate between said fixed hinge pins for engaging said strut assembly in the retracted position for biasing same toward the extended position.

14. The strut assembly of claim 13 wherein said struts are mounted within a doubled walled flexible wing body.

15. The strut assembly of claim 12 including an elongated housing having walls defining an elongated chamber, said base plate defining the bottom of said housing, and said struts are mounted on said plate and postitioned for collapsing to a position totally within said chamber; and detachable cover means covering said chamber for retaining said struts in a collapsed position within said housing.

16. The strut assembly of claim 15 including releasable latching means for retaining said cover on said housing.

17. The strut assembly of claim 16 including spring means mounted on said base plate for engaging and biasing said struts from the colinear position when said cover is released.

18. The strut assembly of claim 13 wherein said spring means comprises a curved leaf spring attached at one end to said base plate and curved outward therefrom.

19. The strut assembly of claim 11 wherein said slot is formed in the outer end of said lower telescoping member and said pin is mounted on and extends outward from said upper telescoping tubular member.

20. The strut assembly of claim 11 wherein said locking means comprises a biased tab formed in the wall of the upper strut for engaging the end of the lower strut when in the fully deployed position.

* * * * *